United States Patent [19]

Pacansky et al.

[11] 4,318,974

[45] Mar. 9, 1982

[54] COPOLYCARBONATE MATERIALS FOR FLASH FUSING TONERS

[75] Inventors: Thomas J. Pacansky, San Jose, Calif.; Robert J. Gruber, Pittsford; John F. Knapp, Fairport, both of N.Y.

[73] Assignee: Xerox Corporation, Stamford, Conn.

[21] Appl. No.: 194,484

[22] Filed: Oct. 6, 1980

[51] Int. Cl.[3] ..... G03G 9/10

[52] U.S. Cl. ..... 430/108; 430/107; 430/109

[58] Field of Search ..... 430/107, 109, 108

[56] References Cited

U.S. PATENT DOCUMENTS 3,590,000 6/1971 Palermiti et al. ..... 430/110
3,694,359 9/1972 Merrill et al. ..... 430/109
4,218,530 8/1980 Lu ..... 430/107

FOREIGN PATENT DOCUMENTS 47-33778 8/1972 Japan ..... 430/109

*Primary Examiner*—Roland E. Martin, Jr.
*Attorney, Agent, or Firm*—E. O. Palazzo

[57] ABSTRACT

Disclosed is an improved toner composition comprised of a colorant and a copolycarbonate resin, which toner has an intrinsic viscosity of from about 0.10 to about 0.6 dl/gr. (deciliters per gram) a melt flow temperature ($T_f$) of from about 70° C. to about 125° C., a flash fusing energy of from about 3 J/in.$^2$ to about 8 J/in.$^2$, (Joules per inch squared), and a glass transition temperature of from about 50° C. to about 65° C.

2 Claims, No Drawings

COPOLYCARBONATE MATERIALS FOR FLASH FUSING TONERS

BACKGROUND OF THE INVENTION

This invention relates generally to toner compositions, and more specifically to toner compositions having certain specific properties, which enable such compositions to be utilized in imaging systems employing flash fusing processes.

The formation and development of images on the surface of electrophotographic materials by electrostatic means is well known, such processes basically involving subjecting a xerographic plate comprising a conductive backing to a uniform charge, and subsequently exposing the photoconductive surface to a light image of the original to be reproduced. The latent image formed on the xerographic surface is developed with toner materials specifically made for this purpose. Thereafter, the developed image can be optionally transferred to a final support material such as paper, and affixed thereto for a permanent record or copy of the original. Numerous methods are known for applying the electroscopic toner particles to the electrostatic latent image such as for example, cascade development, magetic brush development, powder cloud development and touchdown development.

The image can be fixed by a number of various well known techniques including for example vapor fixing, heat fixing, pressure fixing or combinations thereof as described for example in U.S. Pat. No. 3,539,161. These techniques of fixing do suffer from some deficiences thereby rendering their use either impractical or difficult for certain electrophotographic applications. It has been found for example rather difficult to construct an entirely satisfactory heat fuser which has high efficiency, ease of control and short warm-up time. Also heat fusers sometimes burn or scortch the support material, for example the paper. Somewhat similar problems exist with pressure fixing methods, whether used with heat or without heat, and more particularly such problems include for example image offsetting, resolution degradation, and further additionally there cannot be consistently produced a good permanent type of fix. Vapor fixing has several advantages but one of its main problems is that the toxic solvent that is used in many cases makes such a method commercially unattractive because of the health hazards and pollution control standards involved. For example equipment and apparatus to sufficiently isolate the fuser from the surrounding air is very complex, costly, difficult to operate and thus it is difficult to obtain consistent results in such situations.

Many of the modern electrostatographic reproducing apparatus resulted in the development of new materials and new processing techniques, one such apparatus being an automatic electrostatographic reproducing apparatus which is capable of producing copies at an extremely rapid rate. In such situations it appears that the best method for fixing is radiant flash fusing, one of the main advantages of such a technique being the energy which is emitted in the form of electromagnetic waves is available immediately and requires no intervening medium for its propagation. However, although an extremely rapid transfer of energy between the source and the receiving body is provided when using the flash fusing process, a problem encountered with such a system is obtaining an apparatus which can fully and efficiently utilize a preponderance of the radiant energy emitted by the source during a relatively short flash. The toner image usually comprises a relatively small percentage of the total area of the copy receiving the radiant energy and in view of this the properties of most copying materials as for example paper, causes most of the energy to be wasted as it is transmitted to the copy or is reflected away from the fusing area.

Additionally, when radiant energy from the flash fuser is generated at high levels, which is necessary in order to fuse the toner, objectionable odor and smoke results in some instances because of the thermal decomposition of the base resin at the temperature at which fusing must occur. Further, additives have been employed in the prior art in an attempt to eliminate such decomposition but this has not been successful, and also in many instances the additives being used decompose under the process conditions of development.

The flash energy used in a flash fusible toner system is absorbed in a layer of toner of finite thickness adjoining the outer toner surface with the absorption being greatest at the surface, and constantly decreasing with increasing distance from the outer surface. The flash is of very short duration on the order of about 1 millisecond, and consequently the toner very close to the surface is heated to a much higher temperature than the toner mass as a whole, thus in view of the higher temperature the majority of the decomposition that occurs takes place very close to the toner surface. Additionally, the volatile material that is formed cannot be absorbed or entrapped by the decomposed toner matrix and thus it escapes from the toner layer before the toner cools appreciably. Thus the volatile decomposition products formed close to the surface have a much higher probability of escaping as effluents than do those formed deep inside the toner layer. This, together with the greater decomposition close to the surface as compared to the decomposition occuring inside the toner mass, causes the undesirable decomposition products to arise almost entirely in a very thin layer of toner next to the surface. Thus there is need for a material that will eliminate and/or substantially control this decomposition while at the same time being compatible with the toner composition itself, such additive not effecting the system in any other adverse manner. Such an additive should also be able to withstand decomposition itself.

At the same time there is a need for materials such as plasticizers which lower the viscosity of the toner resin, are nonvolatile and thermally stable. It is well known that toner is subjected to mechanical attrition which tends to break down the particles into undesirable dust fines and such fines are detrimental to machine operation in that they are extremely difficult to remove from reusable imaging surface and also because they tend to drift to other parts of the machine and deposition critical machine parts such as optical lenses. The formation of these fines is reduced somewhat when the toner contains a tough high molecular weight resin which is capable of withstanding the shear and impact forces imparted to the toner during the development process. However, unfortunately many high molecular weight materials cannot be employed in high speed automatic machines as they cannot be rapidly fused during a powder image heat fixing step. In order to avoid combustion additional equipment such as complex and expensive cooling units are necessary to properly eliminate the large quantity of heat generated in the fuser. For this reason it is important to lower the point at which the toner flows so that less energy can be used to cause it to perform properly.

One important aspect to be considered in the selection of a proper toner material is its fusibility. For example thus, in the past it has been necessary to consider the nature of the resinous material with respect to these characteristics and in some situations to accomplish the necessary tradeoffs in designing a toner package for electrostatographic apparatus. The development of extremely high speed copying machines, particularly xerographic machines, utilize a developer composition wherein toner exhibits an extremely long life in order that the speed of the apparatus is not compromised by the life of the developer thereby requiring frequent changes of developer because of deficiency in the design thereof. In some cases the toner material may have suitable fusion properties but poor triboelectric charging properties which will result in poor quality images.

SUMMARY OF THE INVENTION

It is an object of the present invention to overcome the abovenoted disadvantages.

It is a further object of the present invention to provide toner materials comprised of copolycarbonates which toner materials are useful in flash fusing imaging systems.

It is a further object of the present invention to provide copolycarbonate toner resins having specific critical flash fusing temperatures, glass transition temperatures, and molecular weight.

It is also an object of this invention to provide a single component dry toner which can be utilized to develop images without employing a carrier, such toners usually containing the polyester of the present invention and a magnetite such as Mapico black.

These and other objects of the present invention are accomplished by providing a toner composition of a colorant and a copolycarbonate resin, which toner has an intrinsic viscosity of from about 0.10 to about 0.6 dl/gr. (deciliters per gram) a melt flow temperature ($T_f$) of from about 70° C. to about 125° C., a flash fusing energy of from about 3 J/in.$^2$ to about 8 J/in.$^2$, (Joules per inch squared), and a glass transition temperature of from about 50° C. to about 65° C. These toners not only exhibit superior critical fusing properties but have extraordinary toughness and long life, and further the toner compositions of the present invention are not subject to blocking during storage, shipping or in the development housing of electrostatographic devices.

In a preferred embodiment of the present invention there is utilized the copolycarbonate, of the following formula which resin is prepared from a bisphenol A, and the bischloroformate of diethylene glycol:

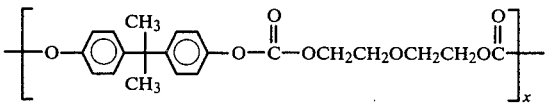

wherein x represents the number of repeating units which number can range up to 100.

Toner compositions comprised of the above copolycarbonate resins are particularly useful in flash fusing systems, as detailed in the working examples. These toner resins have specific critical parameters such as a certain glass transition temperature, as indicated herein.

Illustrative examples of typical copolycarbonates useful in the present invention include poly-4,4'-isopropylidene-bis-2-methylphenylenetrimethylene carbonate, poly(1,3-phenylene-co-ethylene carbonate), poly[4,4'-isopropylidene bis(2-methyl phenylene)-trimethylene carbonate], poly(4,4'-cyclo hexylidene diphenylene-co-oxidiethylene carbonate), poly(4,4'-isopropylidene diphenylene ethylene carbonate), poly(4,4'-isopropylidene diphenylene oxydiethylene carbonate), poly(4,4'-isopropylidene diphenylene oxydiethylene-oxytriethylene carbonate), and the like.

Generally the copolycarbonates of the present invention can be prepared in one embodiment by reacting a dihydric phenol such as bisphenol A, and an aliphatic dihydroxy compound, such as ethylene glycol, utilizing techniques known in the polymer art. Methods commonly employed in preparing random copolycarbonates include for example dissolving a dihydric phenol, such as bisphenol A, and an aliphatic dihydroxy compound, such as diethylene glycol in a solvent containing an acid acceptor, to which is added phosgene. Alternating polymers can be prepared for example by utilizing the bischloroformate of a aliphatic glycol and a dihydric phenol such as diethylene glycol bischloroformate and bisphenol A respectively.

Numerous types of bisphenols can be used to prepare the copolycarbonate of the present invention including 4,4'-isopropylidene-bis-(2-methylphenyl)-4,4'-oxydiphenol, 4,4'-cyclohexylidene-diphenol, 4,4'-cyclohexylidenediphenol, and 4,4'-dihydroxy-diphenyl-sulfone, and the like.

Generally, diphenol reactants of the following formula can be used for reacting with various glycols to form the copolycarbonates of the present invention.

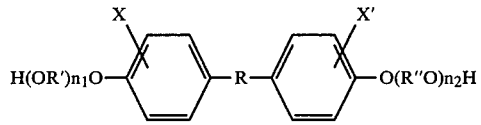

wherein R can be substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' are substituted and unsubstituted alkylene radicals having from 2 to 12 carbon atoms, alkylene arylene radicals having from 8 to 12 carbon atoms and arylene radicals; X and X' represents hydrogen or an alkyl radical having from 1 to 4 carbon atoms; and each n is a number of from 0 (zero) to about 4. Typical diphenols include: 2,2-bis(4-beta hydroxy ethoxy phenyl)propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis(4-hydroxy propoxy-phenyl)-propane, 2,2-bis(4-hydroxy-propoxy-phenyl) propane, 1,1-bis(4-hydroxy-ethoxy-phenyl)-butane, and the like.

Illustrative examples of aliphatic dihydroxy compounds that may be utilized for reaction with the bisphenols include ethylene glycol, diethylene glycol, triethylene glycol, tetraethylene glycol, and mixtures thereof.

A preferred copolycarbonate useful in the present invention is that prepared from bisphenol A and the bischloroformate of diethylene glycol, which material has a glass transition temperature of about 55° C. a melt flow temperature of about 92° C., a flash fusing energy of 3.6 J/in$^2$, and an intrinsic viscosity of 0.150 dl/g.

The toner of the present invention can be prepared by various methods including melt blending followed by grinding or spray drying. In the spray drying process generally there is dissolved in a solvent such as trichloroethylene the appropriate polymer and the resulting solution is then sprayed through an atomizing nozzle using a non-reactive gas such as nitrogen as the atomizing agent. It is during atomization that the solvent used is evaporated from the air born particles thereby resulting in toner particles of uniformly dyed resin. The desired particle size is controlled by varying the size of the atomizing nozzle and the pressure of the atomizing agent, however, generally particles having a diameter of from about 0.5 microns to about 50 microns and preferably from about 10 microns to about 25 microns are obtained.

Any suitable pigment or dye may be employed as the colorant for the toner particles. Toner colorants are well known and include, for example, carbon black, nigrosine dye, aniline blue, Calco Oil Blue, chrome yellow, ultramarine blue, DuPont Oil Red, Quinoline Yellow, methylene blue chloride, phthalocyanine blue, Malachite green Oxalate, lamp black, Rose Bengal and mixtures thereof. The pigment or dyes should be present in the toner in a sufficient quantity to render it highly colored so that it will form a clearly visible image on a recording member. Thus, for example, where conventional xerographic copies of types documents are desired, the toner may comprise a black pigment such as carbon black or a black dye such as Amaplast Black dye, available from the National Aniline Products, Inc. Preferably, the pigment is employed in an amount from about 3 percent to about 20 percent by weight, based on the total weight of the toner. In such an embodiment the copolycarbonate resin is present in an amount of from 97 percent, to 80 percent, by weight. If the toner colorant employed is a dye, substantially smaller quantities of colorant may be used. The pigment or dye should be stable up to about 300° C. and they should not decompose when used in flash fusing systems.

As a developer composition, the toner described above can be employed together without carrier particles, a single component developer, when generally the toner is admixed with a magnetite, such as Mapico black, with 50 percent by weight of each component being present, or with a carrier material, a two component developer. The carrier particles may be electrically conductive, insulating, magnetic or non-magnetic so long as the carrier particles are capable of triboelectrically obtaining the charge of opposite polarity to that of the toner particles whereby the toner particles adhere to and surround the carrier particles. Typical carrier materials include sodium chloride, ammonium chloride, aluminum potassium chloride, Rochelle salt, sodium nitrate, aluminum nitrate, potassium chlorate, granular zircon, granular silicon, methyl methacrylate, glass, steel, nickel, iron, ferrites, ferromagnetic materials, silicon dioxide and the like. The carriers may be employed with or without a coating. Coatings include polyvinylidene fluoride, and polyalkoxy fluorinated materials, both commercially available from E. I. duPont Company. Many of the foregoing and typical carriers are disclosed in U.S. Pat. Nos. 2,618,441; 2,638,416; 2,618,552; 3,591,503; and 3,533,835 directed to electrically conductive carrier coatings, and U.S. Pat. No. 3,526,533 directed to methyl terpolymer coated carriers which are the reaction products or organo silanes, silanols or siloxanes with unsaturated polymerizable organic compounds (optimum among those disclosed are terpolymer coatings achieved with a terpolymer formed from the addition polymerization reaction between monomers or prepolymers of: styrene, methylmethacrylate and unsaturated organo silanes, silanols or siloxanes); and nickel berry carriers as disclosed in U.S. Pat. Nos. 3,847,604 and 3,767,598. Nickel berry carriers are nodular carrier beads of nickel characterized by a surface of recurring recesses and protrusions giving the particles a relatively large external surface area. An ultimate coated carrier particle diameter between about 50 microns to about 1000 microns is preferred because the carrier particles then possess sufficient density and inertia to avoid adherence to the electrostatic images during the cascade development process.

The carrier may be employed with the toner composition in any suitable combination, generally satisfactory results have been obtained when about 1 part toner is used with about 10 to about 200 parts by weight of carrier.

Additionally, there can be added to the developer, that is, the toner and carrier, particularly when the toner particles are prepared by spray drying, a flow agent in order to obtain maximum flow characteristics of the toner in an electrophotographic system. Numerous suitable flow agents may be used including for example colloidal silica, aluminum oxide, titanium dioxide, talc and the like. Such flow agents are submicron in size and preferably range in size from about 50 Angstrom units to about 500 Angstrom. The flow agents are present in amount of from about 0.05 to about 1 percent based on the weight of the toner and preferably from about 0.1 to about 0.5 percent.

The flash fusing systems for use in the flash fusing process employing the toner of the present invention may be any of the well known flash fusers such as those described in U.S. Pat. Nos. 3,529,125, 3,903,394 and 3,474,223. A flash fuser generally utilizes a Zenon flash lamp. The output of the lamp is primarily in the visible and near infrared wavelengths. The output of the flash lamp is measured by joules using the capacitor bank energy in accordance with the formula $\frac{1}{2}CV^2$ wherein C is capacitance and V is voltage. One of the main advantages of the flash fuser over other known methods of fusing is that the energy propagated in the form of electromagnetic waves is immediately available and no intervening source is needed for its propagation. Also flash fusing systems do not require long warm up periods, and the energy does not have to be transferred through a relatively slow conductive or corrective heat transfer mechanism.

The following examples are being supplied to further define the specifics of the present invention, it being noted that these examples are intended to illustrate and not limit the scope of the invention. Parts and percentages are by weight unless otherwise indicated.

The flow temperature of the toner of the present invention was measured utilizing thermal mechanical analysis equipment. In one illustrative example the measurement was accomplished as follows:

A thermal mechanical analysis (TMA) device consisting of a Perkin Elmer Thermomechanical System (TMS-1) which has a sample chamber surrounded by a thermostated oven, a glass probe (with flat bottom surface, expansion probe), a unit for measuring probe deflection and a recorder was used. The temperature of the device was programmed at 20° C./min. using a Perkin Elmer Temperature Program Control Unit (UU-1). The temperature within the sample chamber was monitored using a Cromel-Alumel thermocouple connected in series with an Omega-CJ cold junction compensator and an Omega thermal coupler amplifier (both from Omega Engineering, Stanford, Conn.). The temperature output from the thermal coupler amplifier was used to drive a Hewlett-Packard recorder (7044A x-y Recorder). Temperature readout was obtained by connecting the thermal coupler amplifier to a Doric Integrating Microvoltometer.

In a typical experiment, an approximately 80 mg. toner sample pellet was placed on the flat glass surface of the sample chamber. Tiny asperities formed during molding were previously removed from the edges of the pellet to ensure maximum contact between the pellet and the glass surface of the sample chamber and between the pellet and the glass probe's flat bottom surface. The TMS-1 deflection output was synchronized with the recorder deflection output by zeroing the recorder, as well as the TMS-1. The pellet surface position was indicated on the recorder paper. The sample pellet was then removed and the probe was allowed to rest on the bottom of the sample chamber. This position was also indicated on the recorder paper. The difference between these two positions was a measurement of pellet height. (The pellet height axis can be calibrated using standards of known heights.) The pellet was again placed in the sample chamber. When the glass probe again rested on the pellet surface with maximum contact, the recorder position was the same as that previously determined.

For satisfactorily zeroed samples the heating unit was placed around the sample chamber. When the sample chamber temperature reached 25.0° C., the temperature programmer (at 20° C./min.) and the recorder were started simultaneously. As the temperature increased the top surface of the pellet was monitored, then a large deflection was noted and finally the bottom of the pellet (or surface of the sample chamber) was monitored. When additional weight on the probe did not cause deflection, the bottom surface was reached and the sample was removed by solvent washing. The temperature at which the probe penetrated halfway through the sample was recorded as the flow temperature ($T_f$).

EXAMPLE 1

Preparation of Alternating Copolymer-Bisphenol A-Diethylene Glycol

A solution of 61.06 grams (0.267 mols) of Bisphenol A and 53 grams of pyridine in 670 ml of chloroform was charged into a 3 liter, 3-necked flask, equipped with a mechanical stirrer, reflux condensor, addition funnel, and ice bath. The reaction system was flushed with dry nitrogen and a nitrogen blanket was maintained throughout the polymerization. While stirring the reaction mixture vigorously, a solution of 55.60 grams (0.240 mol) diethylene glycol bischloroformate in 130 ml of chloroform was added dropwise over the course of one hour. About midway through the addition, a white pyridine hydrochloride precipitate was observed. After a reaction time of 5 hours, the reaction was quenched by the addition of 240 ml water. After separating layers, the chloroform layer was washed first with 5 percent aqueous hydrochloric acid, followed by three washes with water or until neutral pH was obtained. The chloroform layer was reduced to about 400 ml by rotoevaporation and then added dropwise to 3 liters of methanol. The precipitate was thoroughly dried at 50° C. in a vacuum oven. There resulted the polymer poly(4,4'-isopropylidene-diphenylene oxidiethylene carbonate) having a glass transition temperature ($T_g$) of 59° C. This material was very stable, that is, it did not decompose, thus no effluents were detected when the polymer was used as a toner resin to develop images in a xerographic imaging system.

EXAMPLE II

The procedure of Example I was repeated with the exception that the bischloroformate of triethylene glycol was used in place of the bischloroformate of diethylene glycol, resulting in the polymer poly(4,4'-isopropylidene-diphenylene-oxytriethylene carbonate).

EXAMPLE III

About 25 grams of the carbonate polymer of Example I is mixed with 2.5 grams of a carbon black material for a period of ten minutes resulting in a toner composition. This toner composition was employed in a xerographic imaging device using a flash fusing system maintained at a temperature of 120° C. and when 1 part by weight of such a toner was mixed together with 10 parts by weight of a steel carrier material in the above described imaging device, there resulted excellent quality prints of high resolution. Additionally, the material did not decompose, thus no effluents were detected.

There was prepared by mixing a toner blend containing 60 percent by weight of the toner of this Example, Example III, and 40 percent by weight of a toner containing 20 grams of the polymer of Example II, and 2 grams of carbon black. This toner blend, 1 part by weight, when mixed with a steel carrier 10 parts by weight, produced images of excellent resolution in a xerographic imaging system, using a flash fusing device maintained at a temperature of 120° C.

As a single component developer there was mixed 50 percent by weight of the above polycarbonate polymer, and 50 percent by weight of the magnetite Mapico black. The resulting developer had a glass transition temperature of 58° C., and a fusing energy of 3.5 Joules/in$^2$, which developer when employed in a xerographic imaging device, using a flash fusing system maintained at a temperature of 115° C., produced excellent quality prints of high resolution.

From about 40 weight percent to about 75 weight percent of magnetite material can be employed, with the polycarbonate material, 25 weight percent to 60 weight percent, when a single component developer is envisioned.

TABLE I

FLASH FUSING ENERGIES FOR TONERS CONTAINING VARIOUS RESINS AND CARBON BLACK

| Toner | Particle Size Microns | $T_f$(°C.) | $T_g$(°C.) | Flash Fusing Energy Joules/inch$^2$ |
|---|---|---|---|---|
| 1. Copolymer of styrene (90%) isobutyl methacrylate,(10%) | 6.6 | 136 | 86 | 5.9 |
| 2. 90% of aco-polymer of styrene (90%)-isobutyl methyacrylate (10%) and 10% black pearls | 6.7 | 130 | 77.5 | 5.0 |

TABLE I-continued

FLASH FUSING ENERGIES FOR TONERS CONTAINING VARIOUS RESINS AND CARBON BLACK

| Toner | Particle Size Microns | $T_f$(°C.) | $T_g$(°C.) | Flash Fusing Energy Joules/inch$^2$ |
|---|---|---|---|---|
| L carbon black | | | | |
| 3. 90% of polystyrene resin, 10% of black pearls L carbon black | 7.1 | 130 | 77 | 5.6 |
| 4. 95% of copoly(styrene-n-butylmethacrylate)5% black pearls L carbon black | 8.0 | 149 | 60 | >8 |
| 5. 90% of copolycarbonate resin of Ex. I, 10% carbon black | 8.0 | 94 | 56 | 3.5 |

The Joules/inch$^2$ represents the amount of energy needed to fuse a talent electrostatic image to paper. Thus a flash fusing energy of 3.5 Jules/inch$^2$ indicates that substantially less energy would be required to fuse such a material, as compared to a material having a flash fusing energy of 5.9.

Other modifications of the present invention will occur to those skilled in the art upon a reading of the present disclosure. These are intended to be included within the scope of this invention.

What is claimed is:

1. An improved developer composition useful in imaging systems employing flash fusing comprised of toner particles, and carrier particles, wherein the toner particles consist of a poly-(4,4'-isopropylidene diphenylene oxdiethylene carbonate), and carbon black, and the carrier particles consist of steel, said toner particles possessing an intrinsic viscosity of from about 0.10 to about 0.6 deciliters per gram, a melt flow temperature from 70° C. to about 125° C., a flash fusing energy of from about 3 joules/inch$^2$, to 8 joules/inch$^2$, and a glass transition temperature of 59° C.

2. An improved developer composition, useful in imaging systems employing flash fusing comprised of toner particles and carrier particles, wherein toner particles consist of a blend of poly-(4,4'-isopropylidene diphenylene oxydiethylene carbonate), 60 percent by weight, and poly-(4,4'-isopropylidene diphenylene oxytriethylene carbonate), 40 percent by weight, and the carrier consists of steel, said toner particles possessing an intrinsic viscosity of from 0.10 to 0.6 deciliters per gram, a melt flow temperature of from about 70° C. to about 125° C., a flash fusing energy of from about 3 joules/inch$^2$ to about 8 joules/inch$^2$ and a glass transition temperature of 58° C.

* * * * *

UNITED STATES PATENT AND TRADEMARK OFFICE

CERTIFICATE OF CORRECTION

PATENT NO. : 4,318,974

DATED : March 9, 1982

INVENTOR(S) : Thomas J. Pacansky et al.

It is certified that error appears in the above—identified patent and that said Letters Patent is hereby corrected as shown below:

On The Title Page, after item (19) "Pacansky et al."

should read -- Gruber et al. --;

Item (75) should read

-- (75) Inventors: Robert J. Gruber, Pittsford,

John F. Knapp, Fairport, both of N.Y.

Thomas J. Pacansky, San Jose, Calif. --.

Signed and Sealed this

*Third* Day of *August 1982*

[SEAL]

*Attest:*

GERALD J. MOSSINGHOFF

*Attesting Officer*

*Commissioner of Patents and Trademarks*